United States Patent [19]

Suzuki et al.

[11] 3,939,610

[45] Feb. 24, 1976

[54] DEVICE AND METHOD OF GRINDING METALLIC MOLDS AND PRODUCTS AUTOMATICALLY

[75] Inventors: Junichi Suzuki, Yamato; Toru Matsuda, Sagamihara; Takahiro Katsube, Yokohama, all of Japan

[73] Assignee: Shatai Kogiyo Co. Ltd., Japan

[22] Filed: July 30, 1973

[21] Appl. No.: 383,491

[52] U.S. Cl. ..... 51/56 R; 51/35; 51/165.77

[51] Int. Cl.[2] ..... B24B 49/08; B24B 49/10

[58] Field of Search ..... 51/2 AA, 35, 56, 165.77, 51/165.9, 165.92

[56] References Cited

UNITED STATES PATENTS

| | | | |
|---|---|---|---|
| 2,116,593 | 5/1938 | Bouvier et al. | 51/2 AA |
| 2,769,280 | 11/1956 | Comstock | 51/34 D |
| 3,019,564 | 2/1962 | Haracz | 51/56 |
| 3,100,954 | 8/1963 | Di Lella | 51/165.77 |
| 3,118,254 | 1/1964 | Di Lella | 51/165.77 |
| 3,466,807 | 9/1969 | Haas | 51/35 |
| 3,618,269 | 11/1971 | Robillard et al. | 51/165.9 |

*Primary Examiner*—Al Lawrence Smith
*Assistant Examiner*—K. J. Ramsey
*Attorney, Agent, or Firm*—Robert E. Burns; Emmanuel J. Lobato; Bruce L. Adams

[57] ABSTRACT

Apparatus and method for abrading or grinding a workpiece with great accuracy. An abrasive support unit is mounted on a vertical column for vertical and horizontal movement. The abrasive support unit is driven automatically along a linear horizontal path and transversely thereof while being driven rotationally. The abrasive support unit has an abrasive mounted thereon on a universal element that provides for universal movement of the abrasive. Servo means are provided for applying the abrasive support unit to the workpiece at a preset pressure. A detector in the form of a differential transformer detects variations in the pressure of application, due to variations in the uneveness of the workpiece, and develops a feedback input to the servo means for applying the abrasive support unit at the preset pressure.

2 Claims, 11 Drawing Figures

DEVICE AND METHOD OF GRINDING METALLIC MOLDS AND PRODUCTS AUTOMATICALLY

BACKGROUND OF THE INVENTION

Hitherto, grinding of the surface of work has been accomplished manually. In recent years, grinding has been accomplished employing devices with a hydraulic self-profiling mechanism. However, such devices are not fully automated. Particularly, if it becomes necessary to correct the grinding pressure immediately and accurately in conformity with changes in the eveness of the surface being ground, correction of the pressure by the hydraulic mechanism only cannot provide an appropriate pressure just in time because of the lag between the time when changes in the surface condition are detected and the time when correction has been finished. During this period of time, the abrasives supporting unit is moved away, and therefore the grinding pressure becomes too high or too low for a new surface to be ground, thus resulting in a decrease of grinding accuracy.

To eliminate the above-mentioned drawback, the provides a device which can ensure an effect which could not have been expected from conventional devices. Namely, the device according to this invention can assure high grinding accuracy by correcting the grinding pressure to an appropriate value automatically while grinding is being performed in conformity with the uneveness and curving of the surface of the work.

SUMMARY OF THE INVENTION

A first object of the invention is to provide a grinding device in which reciprocating motion of the abrasives supporting unit is completely automated by the combined use of electrical circuits and a hydraulic mechanism.

A second object of the invention is to provide a device in which the abrasives supporting unit is set to an appropriate grinding pressure (a set grinding pressure) in advance and the actual grinding pressure developed by changes in the conditions of the portion being ground is detected during grinding and is corrected immediately to the set pressure, thus grinding the portion requiring the corrected grinding pressure under the most appropriate grinding pressure.

A third object of this invention is to provide a device in which the abrasives supporting unit is rotatable and freely inclinable, thus further improving the grinding accuracy and facilitating grinding so as to meet a wide variety of curved surface to be ground.

A fourth object of this invention is to provide a method of grinding the surface of metallic molds to be used for press forming or of products with a high accuracy employing the above-described device.

DESCRIPTION OF THE PREFERRED EMBODIMENTS

Figure 1:
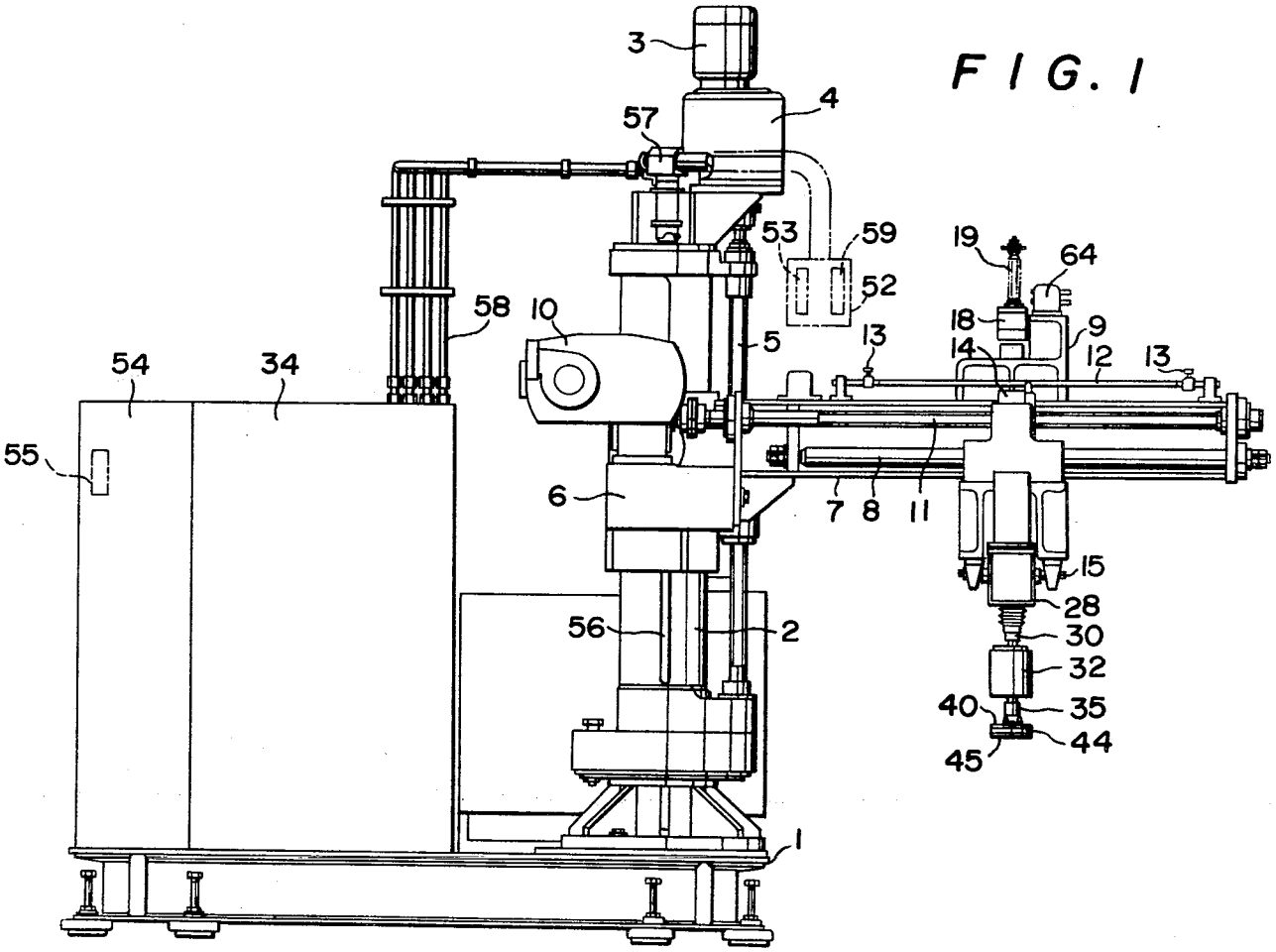
FIG. 1 is a front view of a first embodiment of a device embodying this invention.
Figure 2:
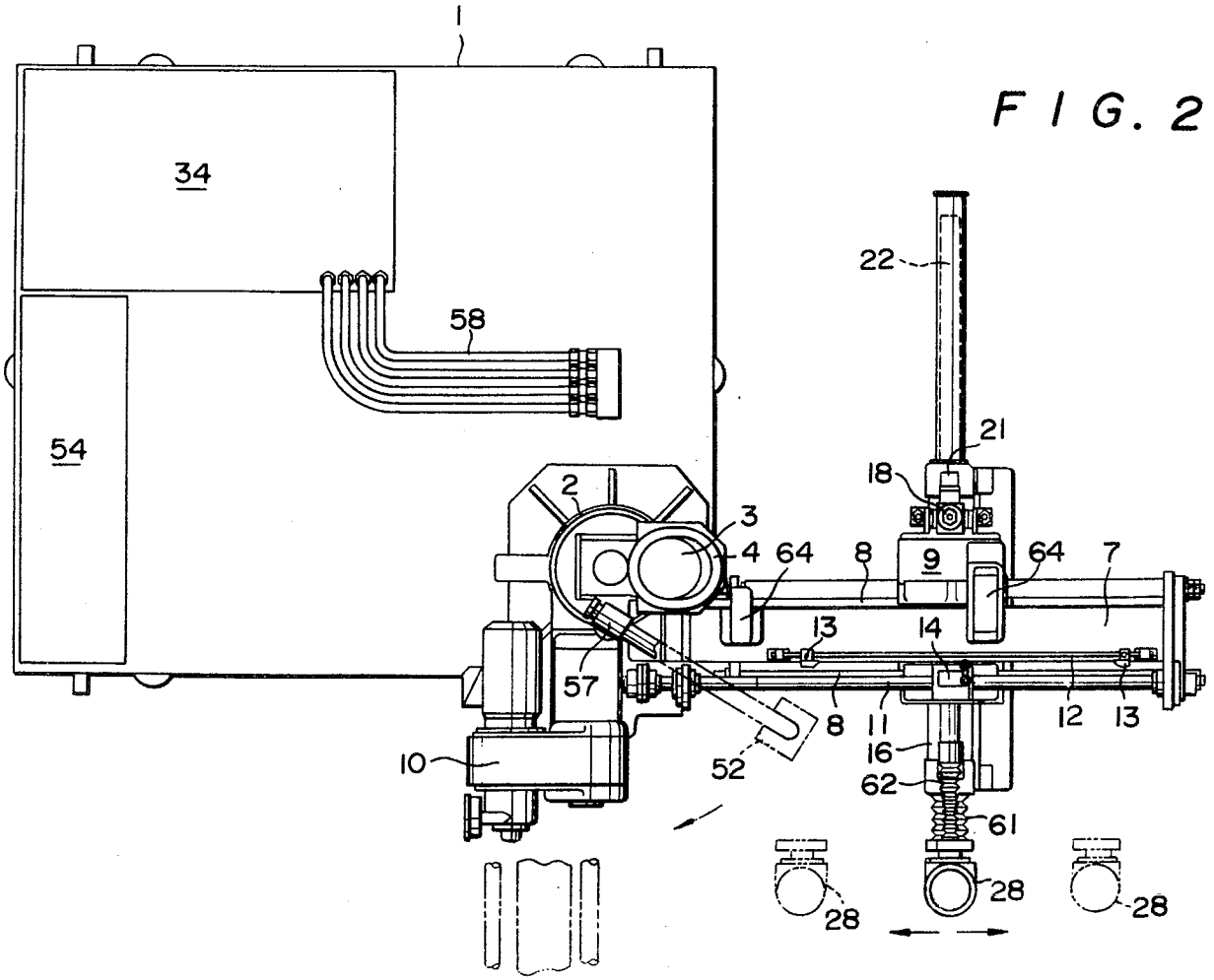
FIG. 2 is a plan view of the device shown in FIG. 1.

To illustrate this invention in more detail, the construction and operation of three preferred embodiments will be described hereinbelow with reference to the accompanying drawings. The first embodiment of the device for automatically grinding metallic molds and products according to this invention comprises a base 1, a column with a column sleeve 2 which is installed vertically on the base 1, and a vertical screw 5 which is provided in parallel with the column sleeve 2 and is rotated through a speed reducer 4 of a motor 3. The column 2 is provided with a cross rail support 6 which moves up and down with the rotation of the vertical screw 5. The cross rail support 6 is provided with a cross rail 7 which is projecting horizontally therefrom. Further, the cross rail support 6 is provided with rods 8 at both sides thereof. A head 9 which slides along the cross rail 7 is supported by the rods 8. A horizontal screw 11 which is rotated by a stepless variator 10 to slide the head 9 back and forth is installed in such a manner that it extends from the cross rail support 6 to the end of the cross rail 7. Cams 13 are provided at the both ends of a guide bar 12 to limit the range of reciprocating motion of the head 9 by changing the rotational direction of the horizontal screw 11. Limit switches 14 which are brought into contact with the cams 13 are provided on the top of the head 9 at one side thereof. Below the limit switches 14, a case 16 is supported by a shaft 15 in a direction at right angles to the cross rail 7. The rear end of the case 16 is supported through a joint 20 at the lower end of a piston rod 19 of a servo cylinder 18 which is in turn supported at another side of the head 9 in such a manner that it is freely inclined. The servo cylinder 18 is provided with a servo valve 21. An arm 22 is slidably inserted into said case 16. Further, a hydraulic cylinder 24 connected to the case 16 through a joint 23 is provided. The arm 22 is provided with a cam 25 to limit the movement of a hydraulic cylinder shaft 26 to the left or right, that is, the sliding distance of the arm 22. Moreover, the case 16 is provided with limit switches 27, 27 which are freely movable.

Figure 4:
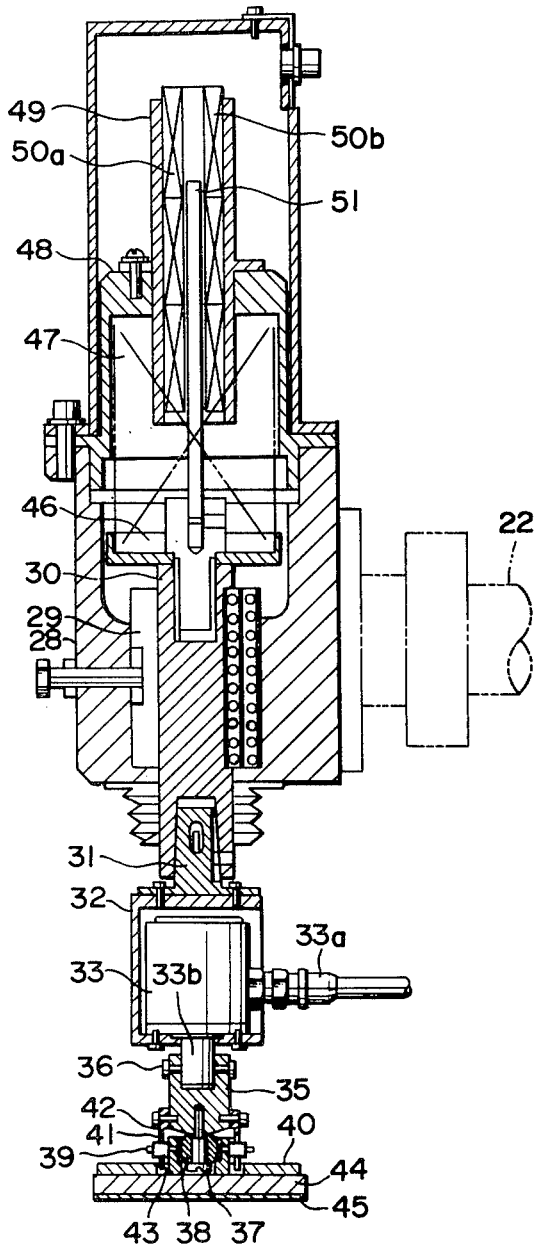
FIG. 4 is an enlarged view of a differential transformer and grinding unit of the first embodiment.

Next, the construction of the grinding unit will be described hereinbelow with reference to FIG. 4. A shaft 30 is inserted slidably through a ball spline 29 into a case 28 fixed to the end of the arm 22. A motor case 32 is fixed through a shank 31 which is inserted into the lower end of the shaft 30. The motor case 32 has a hydraulic motor 33 therein. The hydraulic motor 33 is connected to a hydraulic unit 34 through a hydraulic pipe 33*a*. A delivery shaft 35 is inserted into an output shaft 33*b* protruding downward and is fixed by a screw 36. An universal joint 38 is secured to the lower end of the delivery shaft 35 by a bolt 37. An abrasives supporting member 40 is fixed to the universal joint 38 by means of rotation transfer pins 39. Rotation transfer bars 42 having long holes 41 into which the rotation transfer pins 39 are loosely fitted and whose lower ends are open are fixed to the delivery shaft 35 in the symmetrical positions. The abrasive supporting member 40 is provided with a slot 43 in a position facing the rotation transfer bar 42. An elastic member 44 made of rubber, sponge or the like is attached to the bottom of the supporting member 40. A sand paper 45 which is abrasives is glued to said elastic member 44. Furthermore, a lower bearing 46 is provided on the top of the shaft 30. Above said lower 46, an upper bearing 48 is fixed to the case 28 through a spring 47 which is elastic in the vertical direction. A differential transformer 49 is provided on the upper bearing 48. The differential transformer 49 consists of a primary coil 50*a*, a secondary coil 50*b* and a core 51. The lower end of the core 51 is fixed to the lower bearing 46 so that it is moved up and down together with the shaft 30, but the upper portion thereof is inserted into the coil 50.

Figure 5:
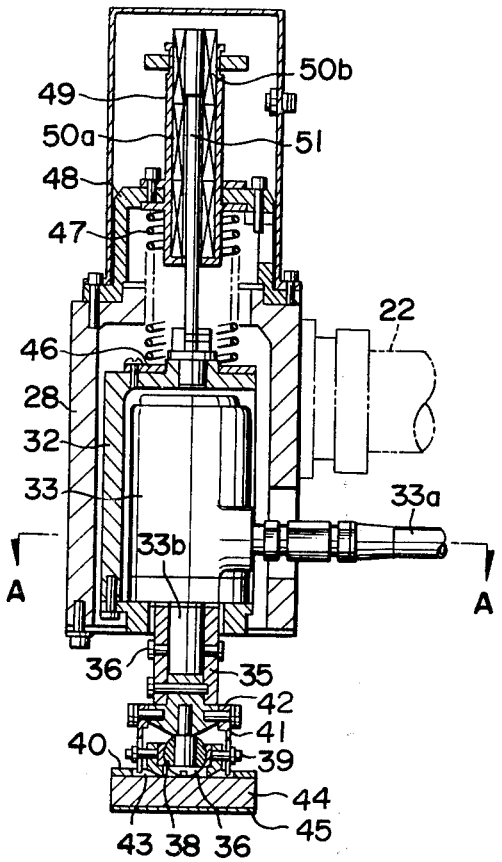
FIG. 5 is an enlarged sectional view illustrating a second embodiment of the differential transformer and gringing unit.

FIG. 5 illustrates the second embodiment in which the hydraulic motor 33 coupled with the grinding unit is directly connected to the core 51. A box 66 having slide ball bearings 65 is vertically slidably inserted into the case 28 provided at the end of the arm 22. The motor case 32 is installed in said box 66. The upper side of the motor case 32 is connected to the lower end of the core 51 and is also fixed to the lower bearing 46.

Figure 7:
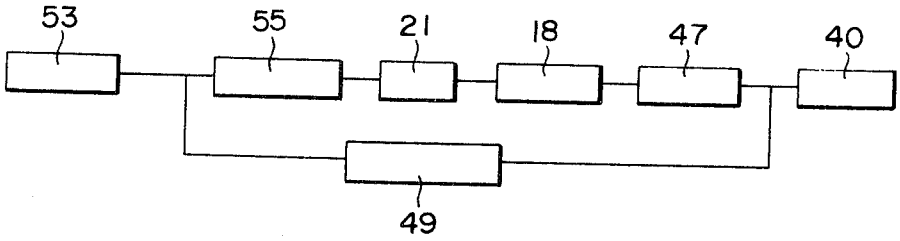
FIG. 7 is an explanatory view of the control circuit of the first embodiment.

The control mechanism for correcting the actual grinding pressure encountered in the abrasive supporting member 40 during grinding to the preset grinding pressure is described below. A load control provided within a pendant box 52, a servo amplifier 55 provided in an electric control device box 54, the servo valve 21 attached to the servo cylinder 18 and the servo cylinder 18 are successively connected as shown in FIG. 7. The lower end of the piston rod 19 is supported at the rear of the case 16 through the joint 20, thus forming the setting circuit. The terminals of the primary and secondary coils 50*a* and 50*b* of the differential transformer 49 are connected to the servo amplifier 55. A circuit is incorporated between the servo amplifier 55 and the servo valve 21.

Figure 3:
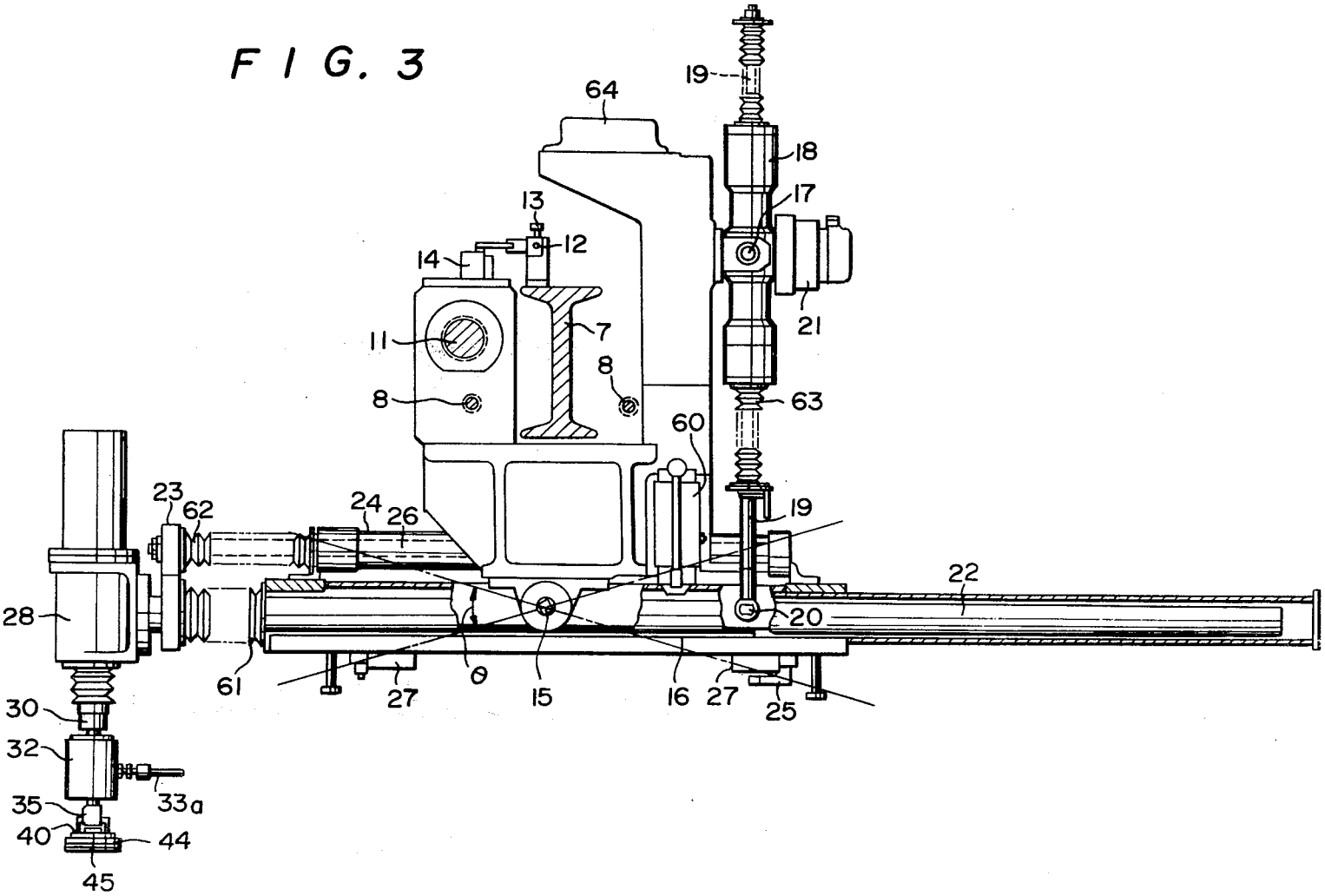
FIG. 3 is an enlarged sectional view, partly broken away, of a portion, of the device in FIG. 1, where the cross rail and the arm are installed.

In the accompanying drawings, the reference numeral 56 indicates a key which is provided between the outer surface of the column 2 and the cross rail support 6 in the vertical direction. The reference numeral 57 designates a pendant box supporting member; 58, a hydraulic pipe; and 59, a counter provided in the pendant box 52. The counter 59 is adapted to count the number of grindings in conjunction with the limit switch 14 provided on the cross rail 7. The reference numeral 60 designates, see FIG. 3, a feed oil unit for the horizontal screw 11; 61 and 62, bellows provided at the outer ends of the case 16 and the hydraulic cylinder 24 to prevent grinding chips from adhering to the arm 22 and the hydraulic cylinder 24; and 63, bellows covering the piston rod 19 from above and below the supporting cylinder 18. The reference numeral 64 indicates a manifold of the hydraulic pipe.

The operation of the device embodying this invention will be described hereinbelow with reference to the second embodiment illustrated in FIGS. 1 through 7.

When each starting button provided in the pendant box 52 is depressed, the rotation of the motor 3 is transmitted through the final reduction gear or speed reducer 4 to the vertical screw 5, as a result of which the cross rail support 6 is lifted or lowered along the column 2. The abrasives supporting member 40 is adjusted to the height of the surface to be ground. The horizontal screw 11 is put into rotation by the action of the stepless variator 10, thereby to slide the head 9 along the cross rail 7. When the limit switches, 14, 14 provided on the head 9 are brought into contact with the cams 13 on the cross rail 7 which have been preset to the specified position at the time of preparations for operation, the stepless variator 10 and the horizontal screw 11 are reversed by the action of the limit switches 14, 14. Thus, the head 9 automatically performs repeated sliding motion. Further, the hydraulic cylinder 24 is put into operation by the action of the hydraulic unit 34, thus causing the arm 22 to slide in the case 16 by means of the joint 23 connecting the hydraulic cylinder shaft 26 and the arm 22. Moreover, the cam 25 installed on the arm 22 is brought into contact with one of the limit switches 27 which are provided at the left and right ends of the case 16 and are preset to the specified positions at the time of preparations for operation. Thus, the hydraulic cylinder shaft 26 and the arm 22 being interlocked with limit switches are caused to make reciprocating motion in the cross direction. The abrasives supporting member 40 automatically performs repeated motion in the direction (cross direction) at right angles to the sliding direction along the cross rail and performs reciprocating motion in the longitudinal and cross directions with respect to the entire surface to be ground. At the same time, the hydraulic motor 33 is operated by means of the hydraulic unit 34, and the delivery shaft 35 and the rotation transfer bar 42 fixed to said delivery shaft 35 are rotated with the rotation of the output shaft 33*b*. Simultaneously, the abrasives supporting member 40 provided on the universal joint 38 is rotated by means of the rotation transfer pins 39 loosely fitted in the long holes 41 of said rotation transfer bars 42. Thus, the sand paper 45 which is abrasives is rotated to grind the work. Since the rotation transfer bars 42, universal joint 38 and the rotation transfer pins 39 fixing the abrasives supporting member 40 are loosely fitted into the long holes 41 provided in the rotation transfer bars 42, the abrasives supporting member 40 can be inclined in any direction under the rotating condition. The sand paper 45 fixed to the elastic member 44 of the abrasives supporting member 40 performs grinding with the grinding pressure which has been preset by operating the load volume 53 in conformity with the material of the work to be ground, finishing accuracy and the grinding speeds of the head and hydraulic cylinder. However, this set grinding pressure is applied to the servo amplifier 55 in the form of an electric signal (voltage signal) and is transmitted as a physical pressure to the sand paper 45 through the servo valve 21, servo cylinder 18 and spring 47. If the uneveness of the surface to be ground is changed and the actual grinding pressure of the sand paper 45 is changed accordingly, minor changes in load to be caused in the sand paper 45 due to changes in the surface being ground are transmitted through the shank 31 to the shaft 30 which is raised and lowered in the ball spline 29. With this movement, the core 51 connected to the lower spring bearing 46 is raised or lowered in the primary and secondary coils 50*a* and 50*b*. Changes in voltage to be caused with changes in the position of the core 51 are transmitted to the input side of the servo amplifier 55, thus detecting changes in the actual grinding pressure. The difference between the changed voltage and the set voltage is amplified by the servo amplifier 55 to operate the servo valve 21. The oil flow controlled by the servo valve 21 serves to drive the servo cylinder 18. With driving of the servo cylinder 18, the case 16 being supported at the lower end of the piston rod 19 by the joint 20 is inclined in the range of angle $\theta$ with the shaft 15 as the fulcrum. At the same time, the arm 22 is also inclined. Accordingly, the contact of the sand paper 45 with the surface to be ground is adjusted from an actual grinding pressure to the appropriate set grinding pressure.

In the construction as shown in the second embodiment where the core 51 of the differential transformer 49 is directly connected with the hydraulic motor 33, the abrasives supporting member 40 is rotated with the rotation of the hydraulic motor 33, thereby to perform grinding. Concerning the changes in the actual grinding pressure to be encountered during the grinding process, the core 51 directly coupled to the hydraulic motor which is moved up and down in accordance with said changes is caused to move in the differential transformer 49 vertically. Changes in the voltage of the transformer are transmitted to the input side of the servo amplifier 55, thus detecting changes in the actual grinding pressure.

Figure 8:
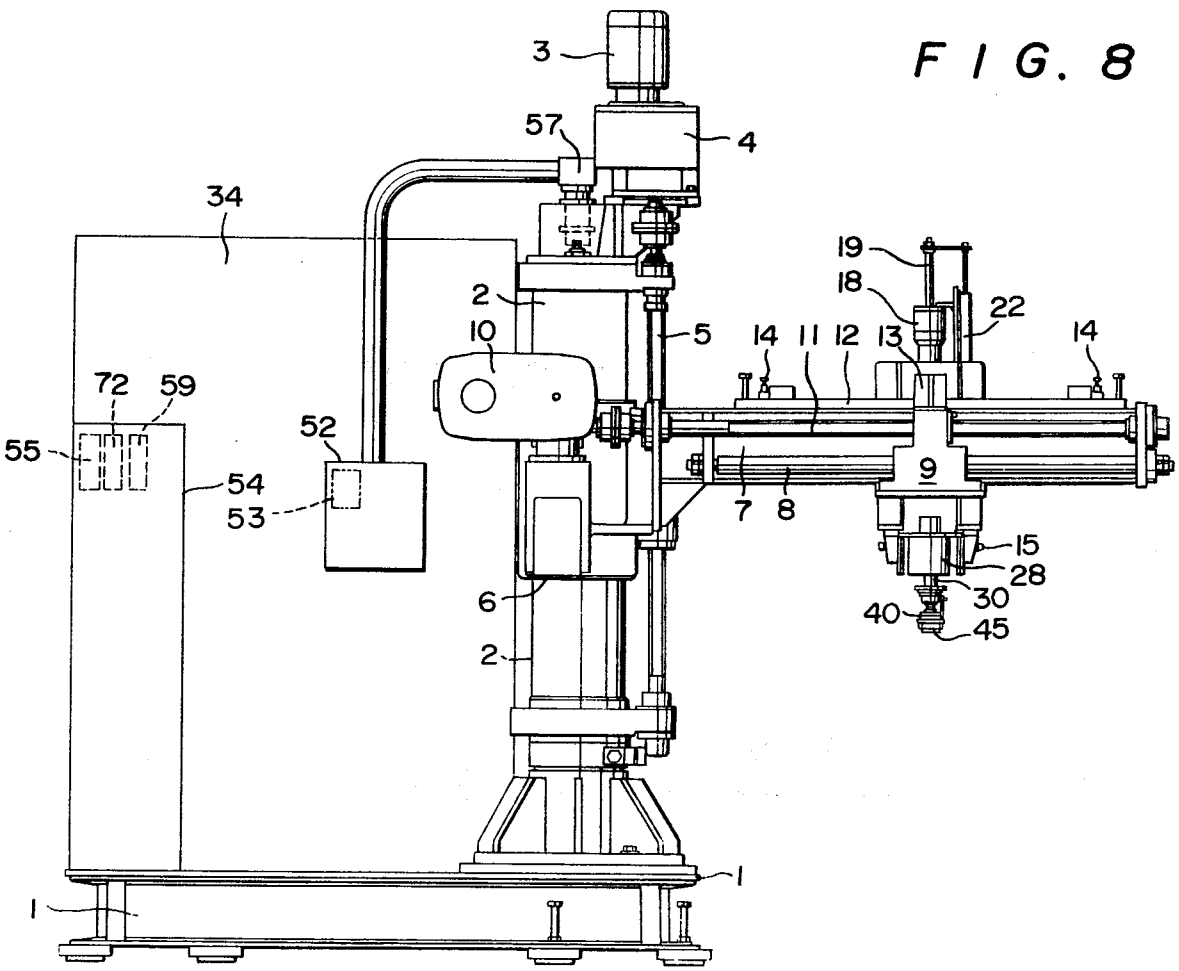
FIG. 8 is a front view of the third embodiment of the invention.
Figure 9:
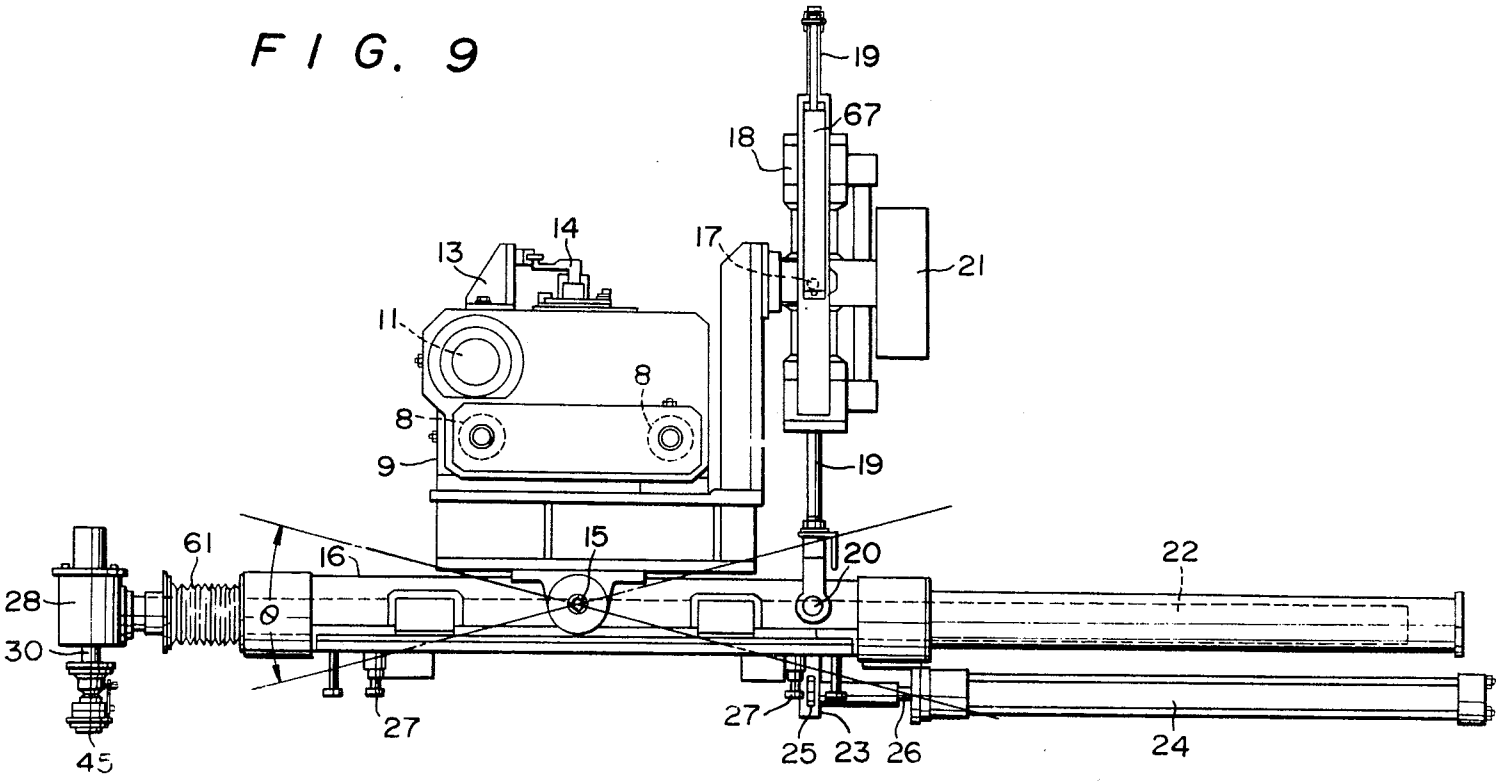
FIG. 9 is a side view of a portion of the third embodiment where a cross rail and an arm are installed.

The third embodiment in which the actual grinding pressure developed in the grinding unit is detected by means of the load detector illustrated in FIGS. 8 through 10 and is corrected to the set grinding pressure will be described herein below. However, the description of said third embodiment will be limited to those portions whose construction is different from that of the first and second embodiments. In this embodiment, the servo cylinder 18 is provided with the servo valve 21 and a potentionmeter 67.

Figure 10:
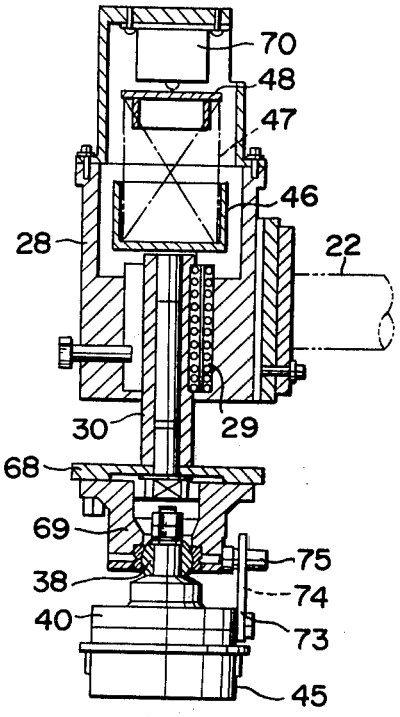
FIG. 10 is an enlarged sectional view of the load detector and grinding unit of the third embodiment.

In the grinding unit of the third embodiment, the shaft 30 is inserted vertically slidably through the ball spline 29 in the case 28 fixed at the end of the arm 22 as illustrated in FIG. 10. A joint case 69 is provided at the lower end of the shaft 30 through a lower plate 68. The joint case 69 rotatably supports the universal joint 38 on which the abrasives supporting member 40 is fixed. The lower spring bearing 46 is provided at the upper end of the shaft 30. Above the lower spring bearing 46, the upper spring bearing 48 is placed by way of the spring 47 which is elastic in the outer vertical direction. A load detector 70 which comes into contact with the upper spring bearing 48 is fixed to a case 71 which is installed on the case 28.

Figure 11:
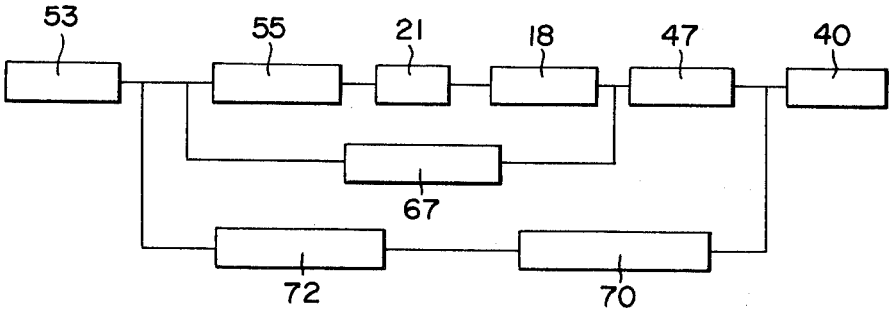
FIG. 11 is an explanatory view of the control circuit of the embodiment shown in FIGS. 8 through 10.
Figure 6:
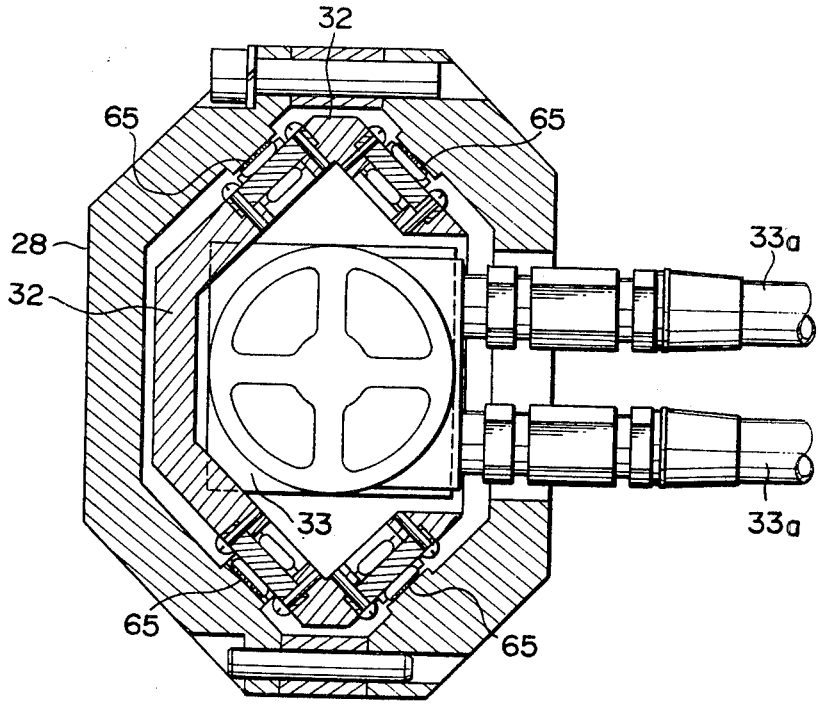
FIG. 6 is an enlarged sectional view taken along the section line A—A of FIG. 5.

Next, the control mechanism adapted to set the grinding pressure and to correct the actual grinding pressure to the set pressure will be described. Referring now to FIG. 11, the load volume 53 installed in the pendant box 52, the servo amplifier 55 installed in the electric control device box 54, the servo valve 21 attached to the servo cylinder 18 and the servo cylinder 18 are connected successively. The lower end of the piston rod 19 is supported at the rear of the case 16 through the joint 20, thus forming the setting circuit. Further, the potentiometer 67 is provided between the input side of the servo amplifier 55 and the output side of the servo cylinder 18, thereby to form the adjusting circuit. Moreover, one end of a strain amplifier 72 located in the electric control device box 54 is connected to the output side of the load volume 53 and another end thereof is connected to the output side of the load detector 70, thus forming the detecting circuit for detecting the actual grinding pressure encountered in the abrasives during the grinding operation.

In the accompanying drawings, the reference numeral 73 designates a rotation stop plate whose lower end is fixed to the abrasives supporting members 40. A stud 75 projecting from the joint case 69 is loosely fitted into a long slot 74 provided in the upper portion of the plate 73.

The operation of the third embodiment illustrated in FIGS. 8 through 11 will be described. When each starting pushbutton provided in the pendant box 52 is depressed, the rotation of the motor 3 is transmitted through the final reduction gear 4 to the vertical screw 5. With this rotation, the cross rail bar 6 is raised or lowered along the column 2 and the abrasives 45 are adjusted to the height of the surface of the mold to be ground so as to be compatible with the set grinding pressure. The horizontal screw 11 is rotated by the action of the stepless variator 10 to slide the head 9 along the cross rail 7. When the cam 13 provided on the head 9 is brought into contact with the limit switches 14 on the cross rail 7, the stepless variator 10 and the horizontal screw 11 are reversed by the action of the limit switches 14. Thus, the head 9 automatically performs repeated sliding motion in the longitudinal direction. Further, the hydraulic cylinder 24 is actuated by the operation of the hydraulic unit 34. With the actuation of the hydraulic cylinder 24, the arm 22 is caused to slide in the case 16. When the cam 25 of the joint 23 connecting the hydraulic cylinder shaft 26 and the arm 22 is brought into contact with one of the limit switches 27 provided at the both sides of the case 16, the hydraulic cylinder shaft 26 and the arm 22 connected with the limit switches are caused to make reciprocating motion in the cross direction. The abrasives 45 automatically perform repeated motion in the direction (cross direction) at right angles to the sliding direction along the cross rail 7, thus performing the reciprocating motions in the longitudinal and cross directions with respect to the entire surface to be ground. The abrasives supporting member 40 is rotatably installed through the universal joint 38. Accordingly, if the surface to be ground is curved, the abrasives supporting member 40 is within the range of certain angles with respect to the curved surface, thus performing grinding freely. If chatter of the abrasives is caused during grinding, the spring 47 acts to absorb it.

On the other hand, the abrasives 45 fixed on the abrasives supporting member 40 perform grinding with a set grinding pressure which has been set by operating the load volume 53 in conformity with the material of the abrasives, the material of the work to be ground, the required finishing accuracy and the grinding speeds of the head and the hydraulic cylinder. This set grinding pressure is applied to the control device of the servo amplifier 55 and the strain amplifier 72 in the form of an electric signal (voltage signal). Minor vertical movement of the abrasives 45 to be caused with changes in the conditions of the surface being ground is transmitted to the shaft 30 through the joint case 69. With the vertical motion of the shaft 30 in the ball spline 29, the lower spring bearing 46 is raised or lowered and the motion thereof is transmitted to the load detector 70 through the spring on the lower spring bearing 46 and the upper spring bearing 48. As a result, changes in the actual grinding pressure are detected.

The difference between the changed voltage and the set voltage is amplified by the strain amplifier 72 and the servo amplifier 55 to operate the servo valve 21. Thus, the servo cylinder 18 is driven by the oil flow controlled by the servo valve 21. With driving of the servo cylinder 18, the case 16 being supported by the joint 20 at the lower end of the piston rod 19 is inclined within a certain angle ($\theta$) with the shaft 15 as the fulcrum. At the same time, the arm 22 is also inclined. Consequently, the contact of the abrasives 45 with the surface to be ground is adjusted from the actual grinding pressure to a pressure which is close to the set grinding pressure. Since the abrasives 45 are always caused to make reciprocating motion by the rotation of the horizontal screw 11 or by the action of the hydraulic cylinder 24, adjustment of the actual grinding pressure in accordance with changes in the condition of the surface being ground may not be carried out quickly in some cases. In such cases, however, the potentiometer 67 installed between the input side of the servo amplifier 55 and the servo cylinder 18 is actuated as a detector for feedback of the standard type loop to improve the stability and accuracy of the control system, thus adjusting the actual grinding pressure to the set grinding pressure instantly and appropriately.

The advantages to be derived by this invention are as follows. According to this invention, the grinding unit performs a grinding operation with an appropriate grinding pressure which has been set in advance. If there are minor changes in the eveness or curving of the surface being ground, an actual grinding pressure which is different from the set grinding pressure is developed in the abrasives supporting member. However, this actual grinding pressure is corrected to the set grinding pressure instantly and automatically.

Consequently, the surface of the work can be always ground appropriately and uniformly under the appropriate set grinding pressure. As automatic grinding of the entire surface is ensured by the automatic reciprocating motion of the head supporting the grinding unit thereon in the longitudinal direction and the automatic reciprocating motion of the arm supported by said head in the cross direction, much labor can be saved.

If the surface is curved, grinding along the curved surface can be ensured by the inclination of the arm and the abrasives supporting member. A high degree of finishing is assured by the rotation of the abrasives supporting member.

In the first embodiment, a differential transformer is used for detection of the actual grinding pressure in the grinding unit, thus resulting in the reduction of the manufacturing cost.

Furthermore, the grinding pressure can be selected, depending on the types of molds, products and abrasives. The grinding area can be changed by the use of limit switches, and the grinding speed can be freely selected. Accordingly, it is possible to grind a wide variety of molds or products.

Furthermore, grinding operation can be carried out continuously by preparing another mold beforehand in the range of the horizontal rotation of the cross rail. Accordingly, time loss associated with preparations which has been inevitable in conventional methods can be eliminated. Moreover, the number of grinding required at the time of preparations for obtaining the desired finishing accuracy can be set by means of the counter provided in conjunction with the limit switches located on the cross rail, and grinding can be stopped automatically when the specified number of grinding has been achieved, thus resulting in a further saving of labor. In addition to the saving of labor by automation of the grinding operation, an operating efficiency which is 10 to 15 times higher than that of conventional methods can be expected.

It is to be understood that many other modifications and variations of details of the construction of the device for grinding metallic molds and products automatically according to this invention are within the scope of the appended claims.

We claim:

1. A device for grinding metallic molds and workpieces automatically comprising, a column, a cross rail support movably mounted on said column and movable in a vertical direction, a cross rail projecting from said cross rail support in the horizontal direction, a head mounted on said cross rail movable automatically in the longitudinal direction of said cross rail, an arm slidable in a direction at right angles to said cross rail and supported by said head so that it can be freely inclined, a case fixed at the end of said arm, a ball spline in said case, a shaft in said case mounted on said ball spline and freely raised and lowered, a differential transformer having a core connected to the top of said shaft, a hydraulic motor directly coupled to the bottom of said shaft and having an output shaft, a universal joint installed on the output shaft of said hydraulic motor, a delivery shaft having rotation transfer bars mounting said universal joint on said output shaft, an abrasives supporting unit having rotation transfer pins on said universal joint, said rotation transfer bars having a long hole for inserting said rotation transfer pin loosely therein, an elastic member on said abrasives supporting unit, abrasives fixed to said elastic member, a load setting means for setting a specific grinding pressure applied to said abrasives, a servo mechanism movable vertically in accordance with voltage difference resulting from a difference between the actual grinding pressure detected by said differential transformer during grinding operation and the set grinding pressure, and a servo cylinder having a piston rod on said head for inclining said arm.

2. Apparatus for grinding metallic workpieces comprising, a vertical column, an abrasive support unit, means supporting said abrasive support unit for movement vertically on said column and for horizontal movement relative thereto, said abrasive support unit having an elastic and deformable element mounted thereon for universal movement, means mounting said elastic and deformable element for universal movement on said abrasive support unit, abrasive means mounted on said elastic and deformable element for abrading a workpiece, means to automatically drive said abrasive support unit along a linear path and transversely thereof while abrading said workpiece including means driving said abrasive support unit rotationally, servo means for presetting a selected pressure said abrasive support unit will apply on said workpiece while abrading it, detection means comprising differential means connected to said abrasive support unit for detecting variations of the actual pressure applied during said abrading and coactive with said servo means for correcting the actual pressure to substantially the preset pressure in conjunction with said servo means, said differential means comprising a differential transformer having a core connected to said abrasive support unit, and means to develop a feedback signal applied to said servo means in dependence upon unevenness of the workpiece being abraded.

* * * * *